US008773306B2

(12) United States Patent
Milano et al.

(10) Patent No.: US 8,773,306 B2
(45) **Date of Patent: *Jul. 8, 2014**

(54) COMMUNICATION SYSTEM AND METHOD USING AN ACTIVE PHASED ARRAY ANTENNA

(75) Inventors: Alberto Milano, Rehovot (IL); Hillel Weinstein, Tel Aviv (IL)

(73) Assignee: Beam Networks, Tel Aviv (IL)

( * ) Notice: Subject to any disclaimer, the term of this patent is extended or adjusted under 35 U.S.C. 154(b) by 460 days.

This patent is subject to a terminal disclaimer.

(21) Appl. No.: 12/679,483

(22) PCT Filed: Sep. 8, 2008

(86) PCT No.: PCT/IL2008/001207

§ 371 (c)(1),
(2), (4) Date: Mar. 23, 2010

(87) PCT Pub. No.: WO2009/037692

PCT Pub. Date: Mar. 26, 2009

(65) Prior Publication Data

US 2010/0188289 A1 Jul. 29, 2010

(30) Foreign Application Priority Data

Sep. 23, 2007 (IL) ..... 186186

(51) Int. Cl.
*H01Q 3/26* (2006.01)
*H01Q 3/34* (2006.01)

(52) U.S. Cl.
CPC ... *H01Q 3/26* (2013.01); *H01Q 3/34* (2013.01)
USPC ..... 342/368; 342/372

(58) Field of Classification Search
CPC ..... H01Q 3/26; H01Q 3/34
USPC ..... 342/368, 369, 375
See application file for complete search history.

(56) References Cited

U.S. PATENT DOCUMENTS

| | | | | |
|---|---|---|---|---|
| 3,524,186 | A * | 8/1970 | Fleri et al. | 342/368 |
| 3,526,898 | A * | 9/1970 | Plunk et al. | 343/771 |
| 3,653,046 | A * | 3/1972 | Glance | 342/371 |
| 3,832,713 | A * | 8/1974 | Rubin | 342/371 |
| 5,475,392 | A * | 12/1995 | Newberg et al. | 342/375 |
| 5,523,764 | A * | 6/1996 | Martinez et al. | 342/372 |
| 6,175,327 | B1 | 1/2001 | Lin et al. | |
| 6,759,980 | B2 * | 7/2004 | Chen et al. | 342/372 |
| 7,852,265 | B2 * | 12/2010 | Milano et al. | 342/367 |
| 2003/0142026 | A1 | 7/2003 | Hadden et al. | |
| 2005/0100102 | A1 | 5/2005 | Gazdzinski et al. | |
| 2005/0163254 | A1 * | 7/2005 | Suzuki et al. | 375/297 |

OTHER PUBLICATIONS

Arima et al, "Microstrip Array Antenna Integrating Push-Push Oscillator and PSK Modulator," IEEE Antennas and Propagation Society International Symposium,6/ 2007, pp. 3344-3347.*

(Continued)

*Primary Examiner* — Gregory C Issing
(74) *Attorney, Agent, or Firm* — Bereskin & Parr LLP/S.E.N.C.R.L., s.r.l.

(57) ABSTRACT

The subject matter discloses a wireless communication system comprising: at least one active phased array antenna unit for transmission and reception of electronic radiation and a phased array circuit for driving and controlling said at least one phased array antenna unit, wherein said at least one phased array antenna unit comprises at least four one dimensional arrays of radiations. The subject matter also discloses a method for utilizing the described system.

19 Claims, 18 Drawing Sheets

(56) References Cited

OTHER PUBLICATIONS

Tsutsumi et al, "A KU-Band Push-Push VCO using Phase Shifters," Proc. of Asia-Pacific Microwave Conf. IEICE 2006, 4 pages.*
Hashemi et al, "A 24 GHz SiGe Phased-Array Receiver—LO Phase Shifting Approach," IEEE Trans. on Microwave Theory and Techniques, vol. 53, No. 2, Feb. 2005, pp. 614-626.*
Jeong et al, "Injection-Locked Push-Push Oscillator at 72 GHz Band Using Cross-Coupled HEMTs," 33rd European Microwave Conf, Munich, 2003, pp. 587-590.*
Birkeland et al, "An Injection Locking Method for Multiple FET Oscillators Suitable for Active Phased Arrays and Quasi-Optical Power COmbining," 1999 20$^{th}$ European Microwave Conf. Sep. 1990, pp. 1505-1510.*
York et al, "Injection- and Phase Locking Techniques for Beam COntrol," IEEE Trans. on Microwave Theory and Tech. vol. 46, No. 11, Nov. 1998, pp. 1920-1929.*

* cited by examiner

PHASED SHIFTER INJECTED OSCILLATOR

COMMUNICATION SYSTEM AND METHOD USING AN ACTIVE PHASED ARRAY ANTENNA

RELATED APPLICATIONS

Patent applications serial number PCT/IL2006/001144 filed on Oct. 3, 2006 and titled PHASE SHIFTED OSCILLATOR AND ANTENNA and PCT/IL2006/001039 filed on Sep. 6, 2006 and titled APPARATUS AND METHODS FOR RADAR IMAGING BASED ON INJECTED PUSH PUSH OSCILLATORS the disclosures of which are incorporated herein by reference.

FIELD OF THE INVENTION

The present invention relates generally to the field of broadband access and more particularly to a wireless communication method and system using an active phase array antenna to be used in systems like WIMAX, WIFI, WPAN, cellular communication and the like

BACKGROUND OF THE INVENTION

There is an increasing demand thr broadband wireless access solutions. The term WI-MAX was defined as Worldwide Interoperability for Microwave Access by the WI-MAX forum that was acting to promote conformance and interoperability of the IEEE 802.16 standard.

Several methods and technologies were adopted in order to enable broadband access compliant with IEEE 802.16 and similar standards, the most common technology that support this standard is known as MIMO—Multiple In Multiple Out, a technology that is based on deployment of several antennas.

However, the MIMO technology suffers from some prominent drawbacks mainly due to its relative high cost. Furthermore, MIMO as other technologies being in use for WIMAX, WIFI, WPAN and cellular communications does not offer a system and method to cope with dynamic changes of required bandwidth and does not offer an efficient method to enable precise directional transmission and receiving.

While the foregoing introduction referred to WIMAX, very similar problems are associated with WI-FI standard (IEEE 802.11), WPAN (IEEE802.153C), common cellular communication protocols and other methods and protocols as well. The present invention is designed to solve similar problems for such and other like now known or later developed communications methods and protocols.

SUMMARY OF THE INVENTION

An aspect of an embodiment of the invention, relates to a system and method for performing wireless communication between objects spaced a distance from a few meters to a number of kilometers by transmitting and receiving electronic signals via active phased array antenna systems. For example communication between a cellular station and plurality of cellular phone devices, WIMAX, WIFI, WPAN, cell phone communication between a control station and a car control unit, HDTV transmission from a TV Set Top Box (STB) to HDTV Receivers, and the like.

In an exemplary embodiment of the invention, an antenna unit consisting four one-dimensional phased arrays of radiators enables communication (transmitting and receiving) with a plurality of devices, wherein the antenna unit is switching among plurality of radiation modes for enabling efficient transmission (or receiving) to specific devices that are located in a wide angel around the antenna unit.

It is further an object of the invention to provide low cost systems for enabling high rate communication among a plurality of receiving/transmitting objects.

it is further an object of the invention to provide a system and method for high throughput communication for outdoor as well as indoor applications.

There is thus provided in accordance with an exemplary embodiment of the invention a wireless communication system comprising one or more phased array antenna units for transmission and reception of a radiation, a phased array circuit for driving and controlling the one or more phased array antenna units, wherein the one or more phased array antenna units comprise four or more dimensional arrays of radiators.

In some embodiments of the invention, the phased array antenna unit can be active.

In some embodiments of the invention, the dimensional arrays of radiators are linear.

In some embodiments of the invention, the phased array antenna unit is positioned in a vertical orientation.

In some embodiments of the invention, the dimensional arrays of radiators are symmetric.

In some embodiments of the invention, the dimensional arrays of radiators are linear and symmetric.

In some embodiments of the invention, the even dimensional arrays of radiators are shifted with reference to the odd one dimensional arrays of radiators by about half of the distance between two adjacent radiators.

In some embodiments of the invention, the one or more phased array antenna units comprise four or more radiators, wherein one of two or more groups of radiators is defined, as a reference group and two or more of the four or more groups of radiators are controlled by the phased array circuit to transmit and receive with a programmable phase shift relative to said reference group In some embodiments of the invention, each group of radiators comprises at least one dimensional array of radiators.

In some embodiments of the invention, the programmable phase shift is +180 or −180 degrees.

In some embodiments of the invention, the system is selectively switching between three or more radiation modes, where a radiation mode is defined according to the number of groups of radiators that transmit and receive each in a different phase shift and according to the programmable phase shift that is associated with each group of radiators.

In some embodiments of the invention, the selectively switching between the three or more radiation modes enables communication with objects over a substantially wide horizontal angle.

In some embodiments of the invention, the wide horizontal angle is greater than 90 degrees.

In some embodiments of the invention, the selectively switching between the three or more radiation modes depends on signal level received in the three or more radiation modes.

In some embodiments of the invention, the phased array circuit controls the phased array antenna unit to radiate in a vertical beam aperture.

In some embodiments of the invention, the narrow vertical beam aperture is steered vertically according to a programmable pattern.

In some embodiments of the invention, the phased array circuit includes two level of PSIPPO; and the narrow vertical beam aperture is steered vertically according to a programmable pattern by providing control signals to the two level of PSIPPO.

In some embodiments of the invention, the communication system is used for outdoor communication.

In some embodiments of the invention, the communication system is used for indoor communication.

In some embodiments of the invention, the one or more phased array antenna units for transmission and reception of radiated electronic signals transmits or receives various now known or later developed communications protocols and methods. Such can include, for example, WIMAX or WIFI or HDTV or cellular communication compliant data signals, or any combination thereof.

In some embodiments of the invention, the system comprises four phased array antennas, positioned in a substantially rectangle structure to cover a 360 degrees of the area surrounding the antennas.

BRIEF DESCRIPTION OF THE DRAWINGS

The present invention will be understood and appreciated more fully from the following detailed description taken in conjunction with the drawings. Identical structures, elements or parts, which appear in more than one figure, are generally labeled with a same or similar number in all the figures in which they appear, wherein.

DETAILED DESCRIPTION OF THE INVENTION

In PCT/IL2006/001144 filed on Oct. 3, 2006 and in PCT/IL2006/001039 filed on Sep. 6, 2006 the disclosures of which are incorporated herein by reference there are described elements and circuit designs for providing low cost and light weight distributed active phased array antennas. The applications describe circuits, which can be implemented as low cost and small sized circuits or manufactured as integrated chips to generate and control the signals transmitted and detected by phase array antennas. The current application implements the concepts described in the above, applications to provide suitable active phase array antennas for implementing the current invention as further described below.

The present application uses a device referred to as "phased shifted injection locked push-push oscillator" (PSIPPO) which is defined and described below in the following text. FIGS. 5-12 and the accompanying description describe the structure of the PSIPPO and its usage in a phased array antenna system.

Figure 5:
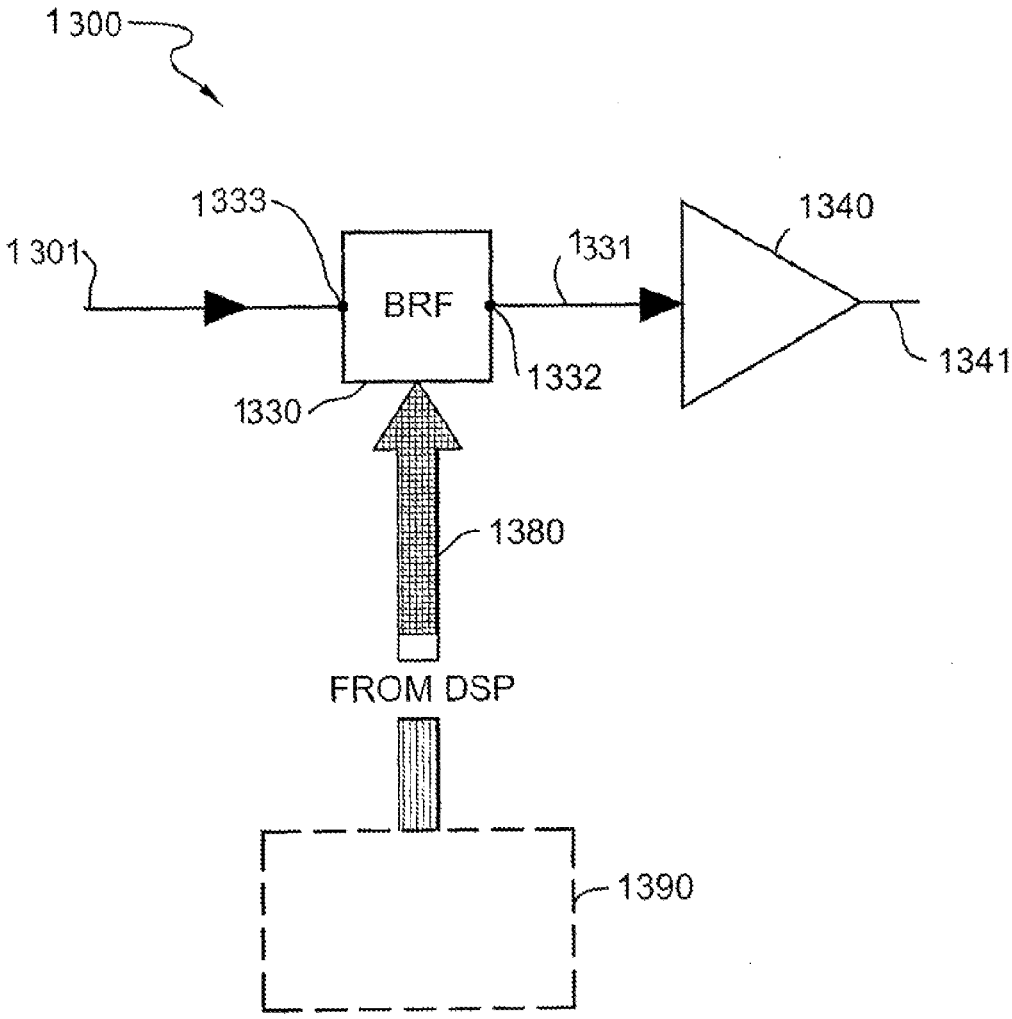
FIG. 5 is a schematic diagram of a phased shifted injection oscillator (PSIO), according to an exemplary embodiment of the invention.

FIG. 5 shows a schematic diagram of a circuit 1300, called in this specification PSIO, according to an exemplary embodiment of the invention. The PSIO of FIG. 5 comprises a reflection amplifier 1340 connected to a band rejection filter (BRF) 1330. The BRF comprises a varactor diode whose bias voltage is controlled by a digital signal processor (DSP) 1390. The BRF 1330 has two ports 1332, 1333.

Figure 6:
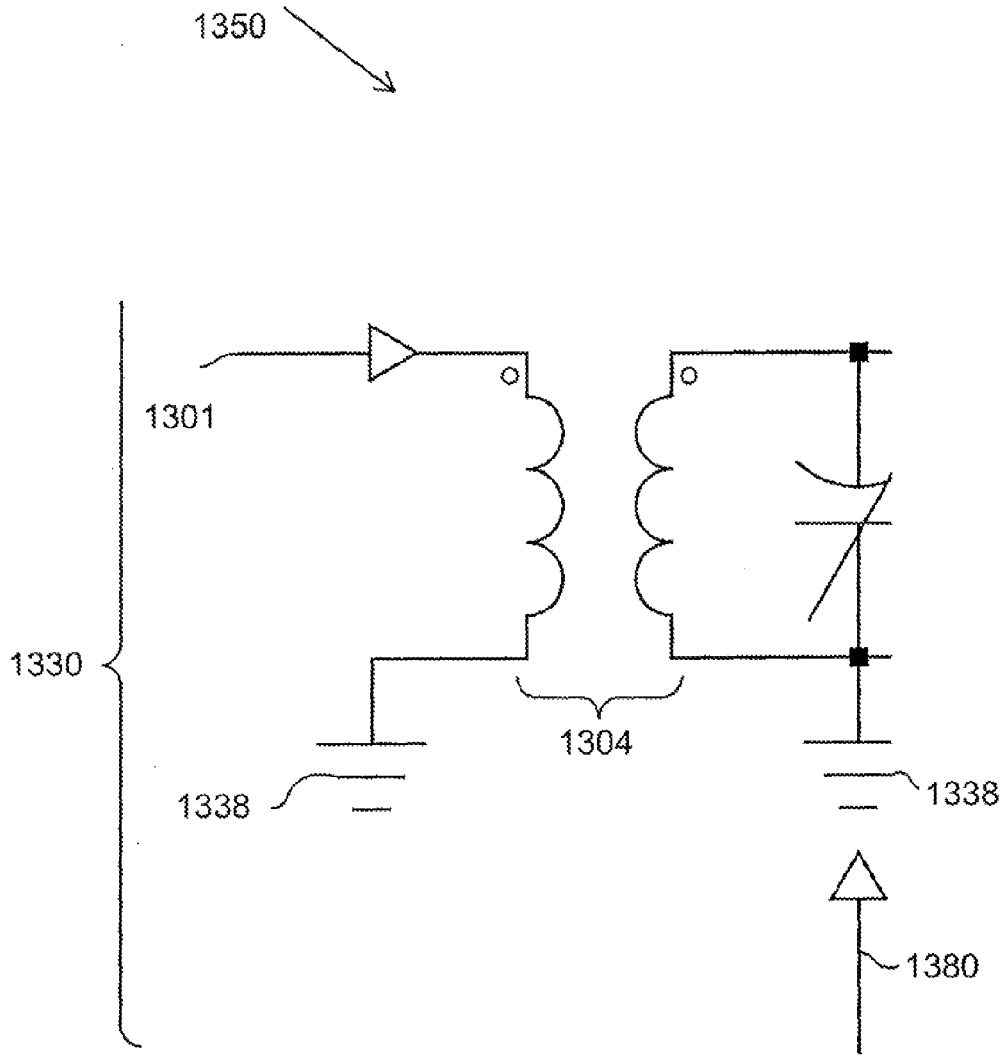
FIG. 6 is a schematic diagram a band rejection filter (BRF) according to an exemplary embodiment of the invention.

FIG. 6 is a schematic diagram 1350 of the BRF 1330 according to an exemplary embodiment of the invention. The BRF 1330 comprises at least one variable capacitor 1352 and at least one inductor 1304 embedded in an isolating transformer able to resonate with the variable capacitor 1352 for making resonance with band rejection filter of the PSIO. Numeral 1338 denotes ground. The variable capacitor 1352 of FIG. 3 is voltage controlled by signals 1380 generated by the DSP 1390 (DSP 390 is not shown in FIG. 3).

Figure 7:
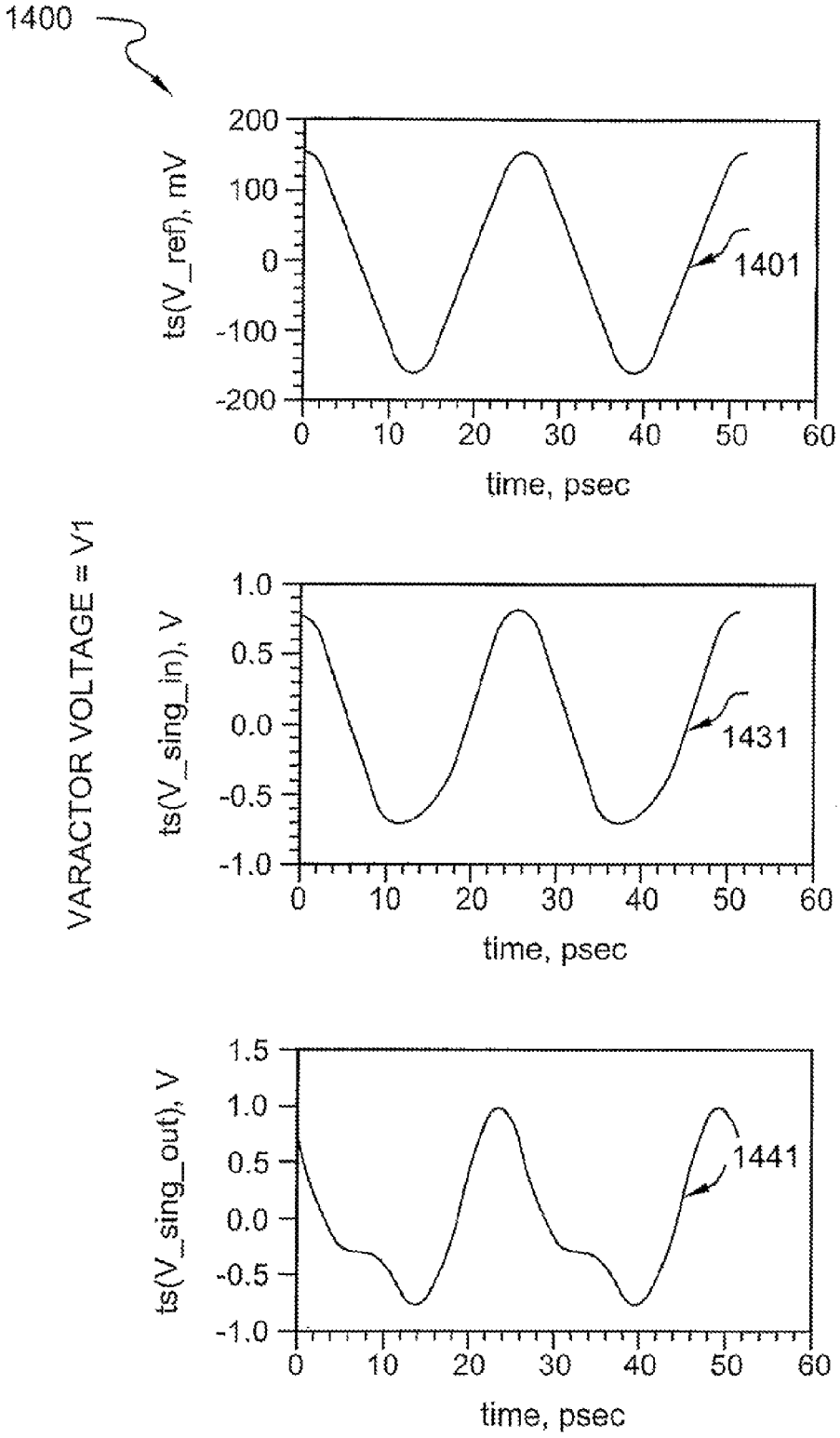
FIGS. 7, 8 are non-limiting examples illustrating a behavior of a PSIO, in accordance with exemplary embodiments of the invention.
Figure 8:
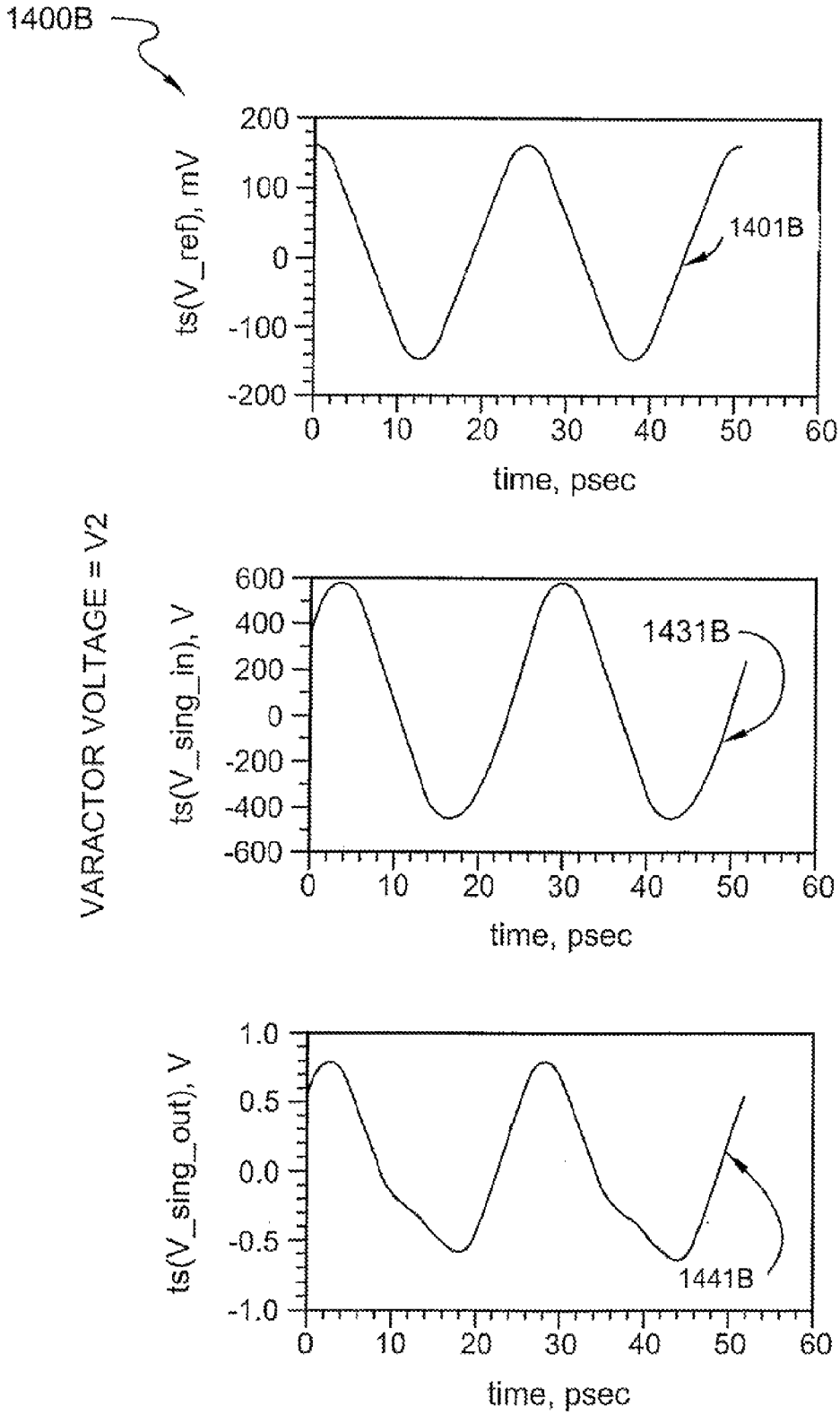

In an exemplary embodiment of the invention signal 1301 of FIG. 2 is injected into the PSIO 1300 so that the output signal 1341 of the PSIO 1300 is locked to signal 1101. The locking of signal 1341 means that signal 1341 is also locked and has the same frequency and about the same basic spectral purity as the signal 1301. The behavior of the PSIO 1300 of FIG. 5 will be better understood together with FIGS. 7, 8. FIGS. 7, 8 are a particular non-limiting example illustrating the behavior of the PSIO 1300. The PSIO 1300 receives an input RF signal 1301 and outputs a signal 1341 having the same frequency and about the same basic spectral purity as the input reference 1301. Waveforms 1401, 1401B are waveform illustrations of signal 1301 for two different voltages V1 and V2 of the variable capacitor 1352. Similarly waveforms 1441, 1441B illustrate waveforms of signal 1341 for two different voltages V1 and V2. It can be seen that signals 1441 and 1441B have a different phase.

Waveforms 1401, 1431, and 1441 represent the time domain voltages at certain location of the PSIO, corresponding to voltage V1 on the variable capacitor 1352. Waveforms 1401B, 1431B, 1441B represent the time domain voltages at certain locations of the PSIO, corresponding to voltage V2 on the variable capacitor 1352. It should be noticed that waveform 1401 corresponds to 1301, waveform 1431 corresponds to 1331, and waveform 1441 corresponds to 1341.

In an exemplary or preferred embodiment of the invention the variable capacitor 1352 of BRF 1300 is used to chance the resonant frequency of the BRF 1330, and the variable capacitor is controlled by the DSP 1390.

Figure 9:
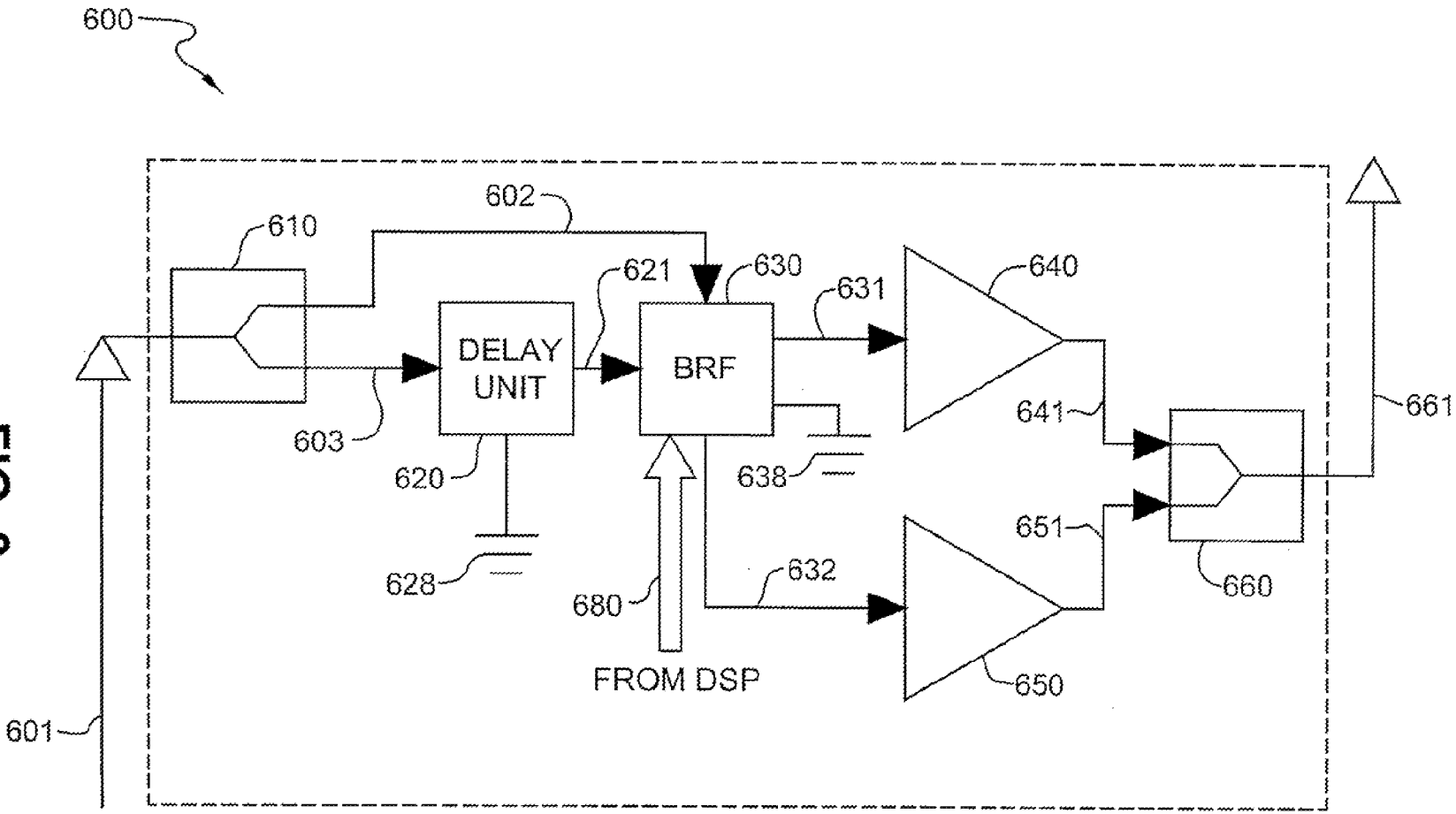
FIG. 9 is a simplified block diagram illustration of a phased shifted injection locked push-push oscillator (PSIPPO), in accordance with an exemplary embodiment of the invention.

FIG. 9 is a simplified block diagram illustration 600 of a phased shifted injection locked push-push oscillator (PSIPPO), in accordance with an exemplary embodiment of the invention. In an exemplary embodiment of the present invention the PSIPPO comprises a power divider 610, a time delay unit1 620, a band rejection filter BRF 630, at least two reflection amplifiers 640 and 650, a power combiner 660.

Figure 10:
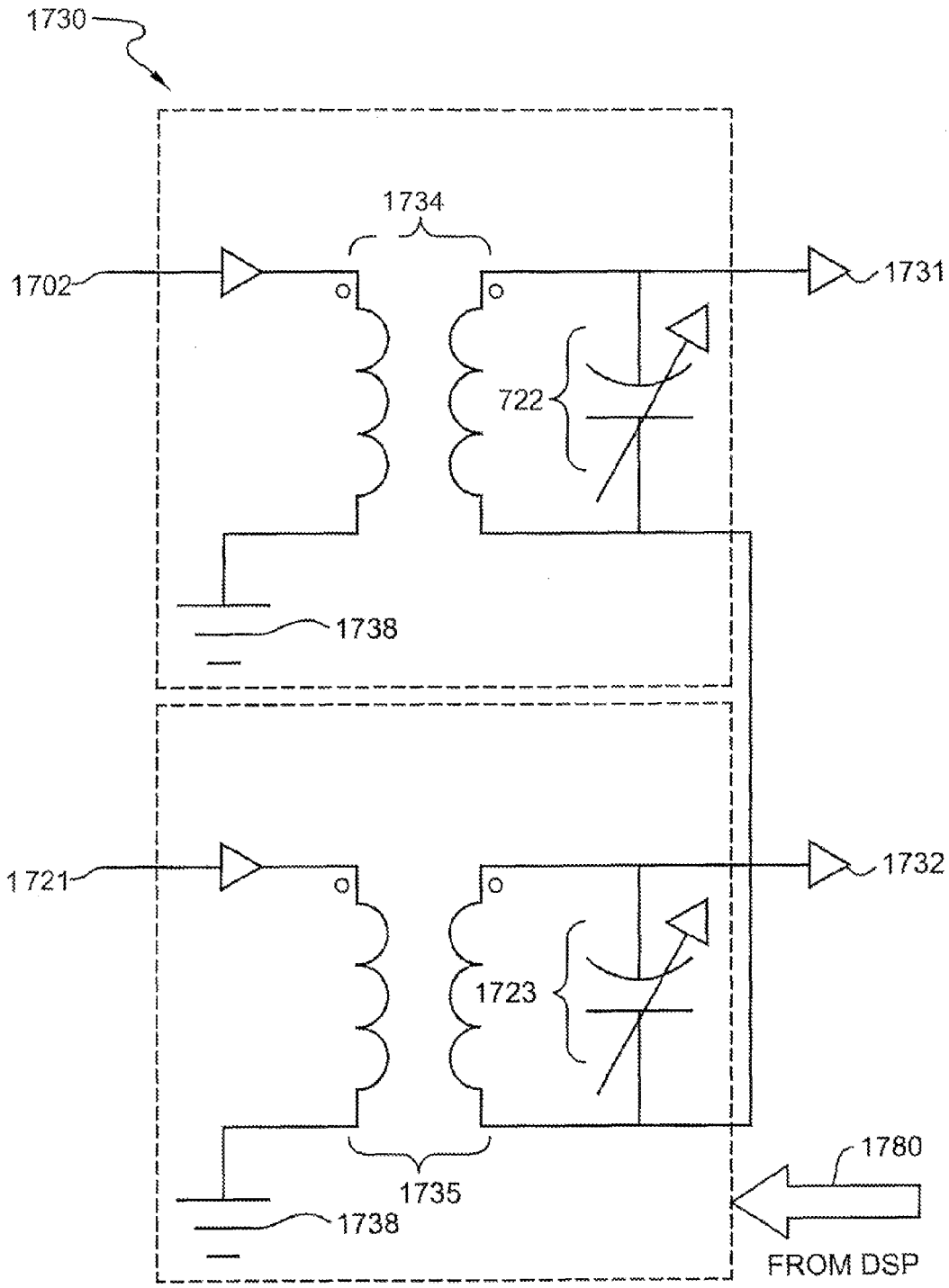
FIG. 10 is a schematic diagram of a BRF, according to an exemplary embodiment of the invention.

FIG. 10 is a schematic diagram of the BRF 1630 of FIG. 9, according to an exemplary embodiment of the invention. The BRF 1730 comprises at least two inductors 1734, 1735 embedded in two isolating transformers able to resonate with the variable capacitors 1722, 1723. Numeral 1738 denote ground. The variable capacitors 1722, 1723 are voltage controlled by signals 1380 generated by the DSP 1390 shown in FIGS. 5, 6.

The behavior of the PSIPPO 1600 of FIG. 9 will be better understood together with FIGS. 11A, 11B, 11C, 11D. The PSIPPO 1600 receives a signal 1601 having a certain phase and outputs a signal 1661 having the same or a different phase than the input signal 1601.

In an exemplary embodiment of the invention signal 1601 is a reference signal or a signal from a previous PSIPPO and signal 1661 is outputted to another PSIPPO or to a radiator.

Figure 11A:
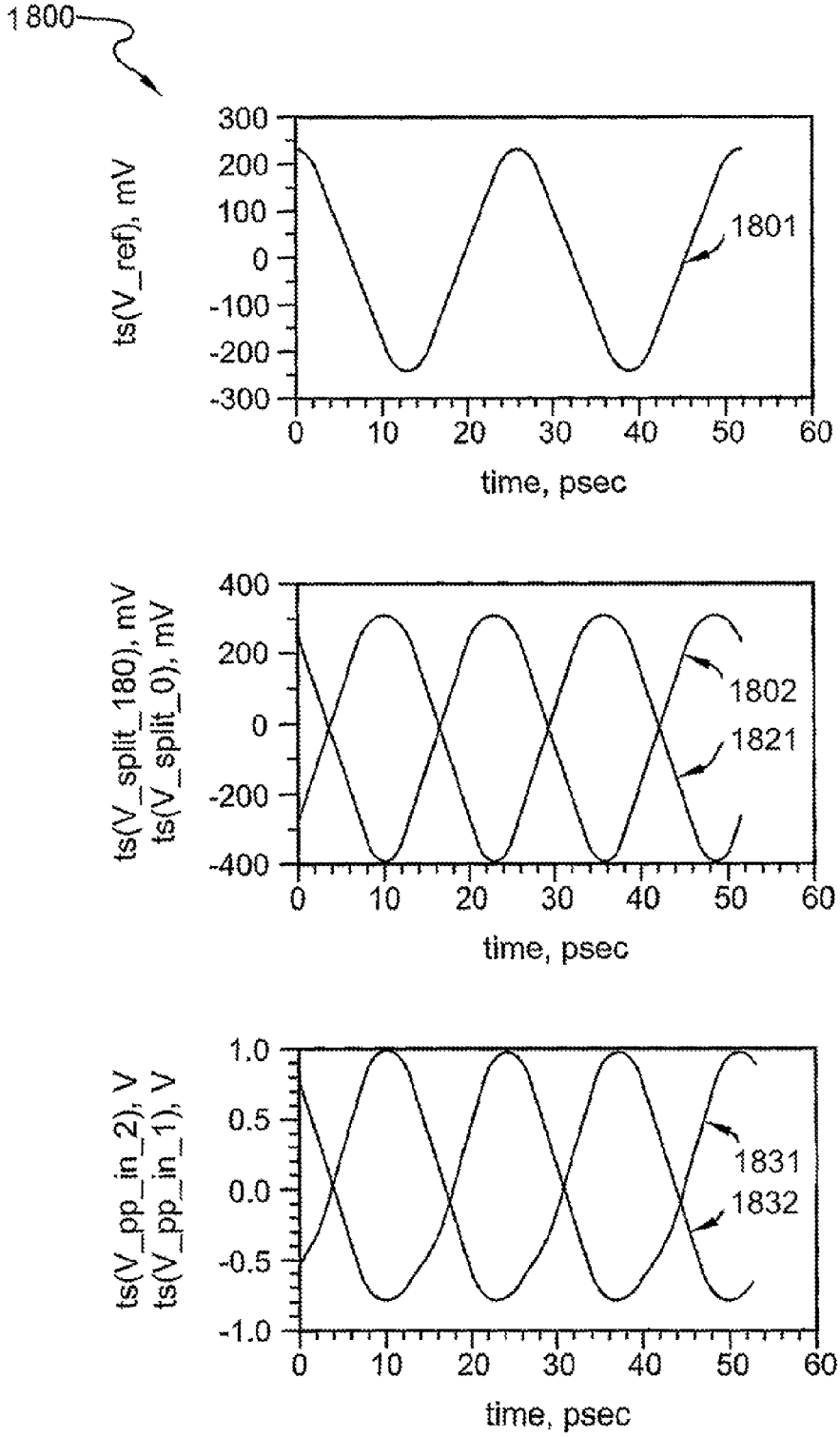
FIGS. 11A, 11B, 11C, 11D are non-limiting example illustrating a waveform behavior of a phased shifted injection locked push-push oscillator (PSIPPO), in accordance with exemplary embodiments of the invention.
Figure 11B:
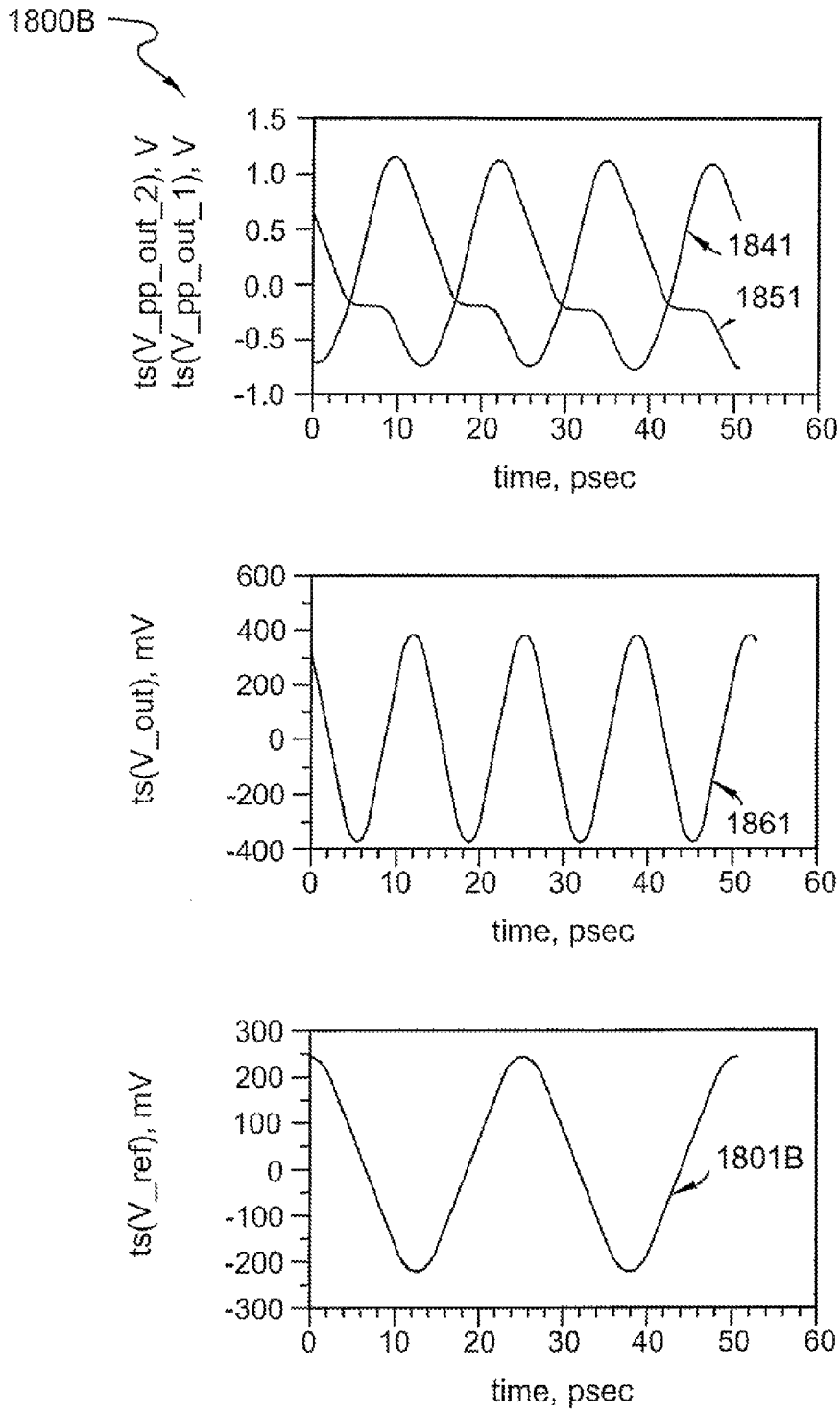
Figure 11C:
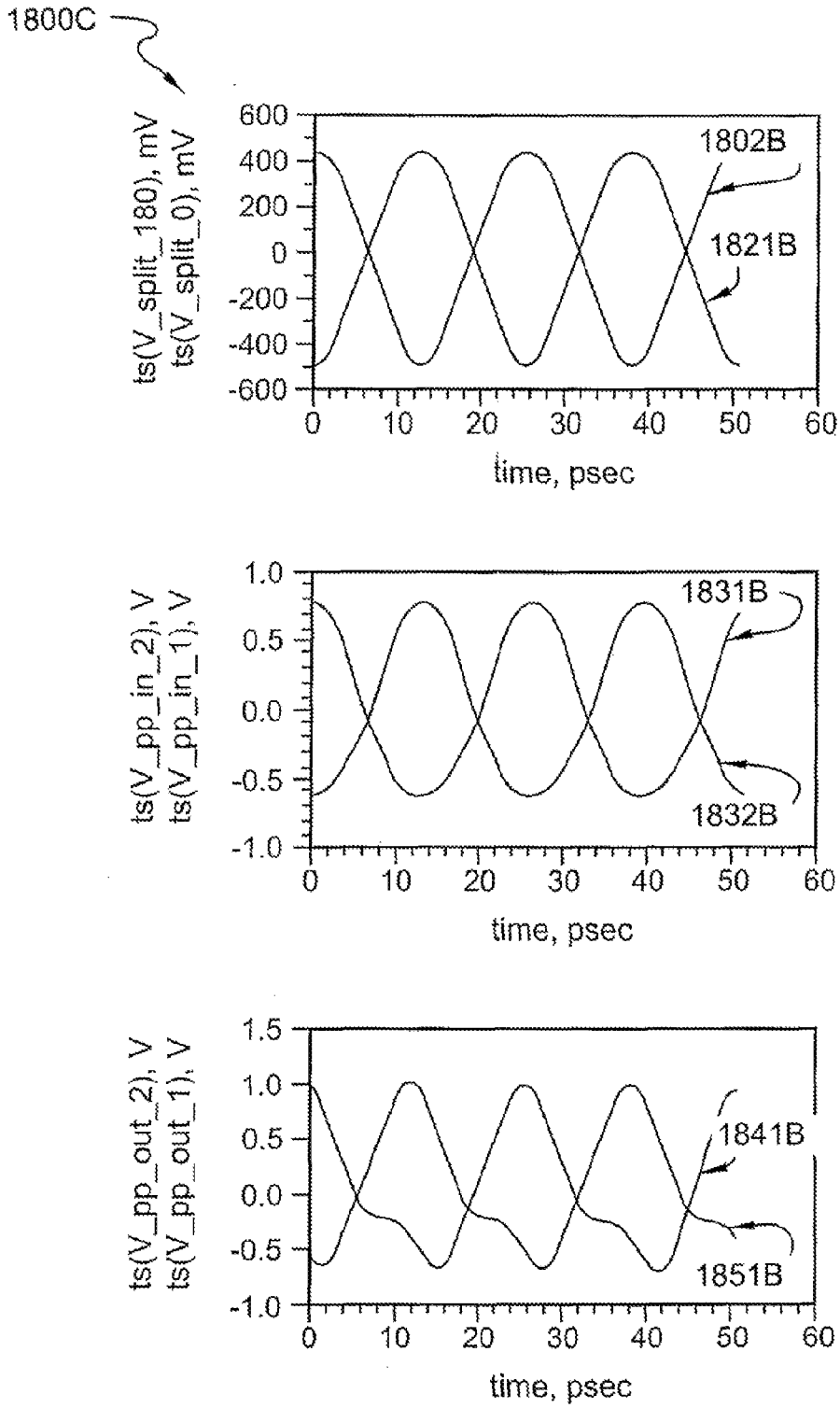
Figure 11D:
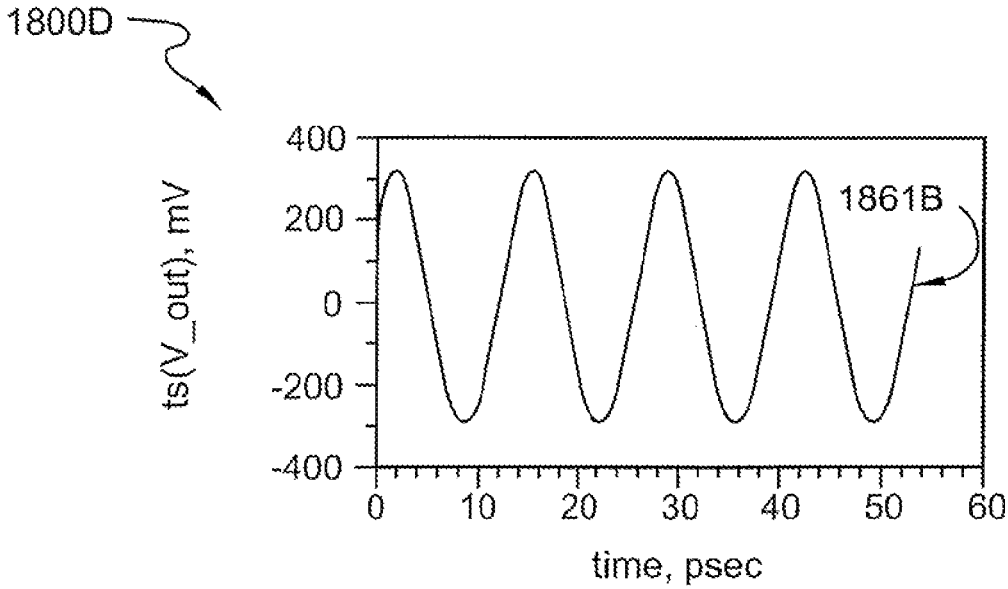

Waveforms 1801, 1801B in FIGS. 11A, 11B are waveform illustrations of input reference signal 1601 for two different voltages V1 and V2 respectively, and waveforms 1861, 186B in FIGS. 11B, 11D are waveforms illustration of signal 1661 for two different voltages V1 and V2, in a particular non-limiting example. The output signal 1661 has twice the frequency and twice the phase angle of the input reference signal 1601. A person skilled in the art will appreciate that the output signal 1661 can have twice the frequency and about twice the phase angle of the input reference signal 1601.

The power divider 610 receives the signal 601 and inject a first portion 602, illustrated by waveforms 1802, 1802B in FIGS. 11A, 11C and second portion 621 illustrated by waveforms 1821, 1821B in FIGS. 11A, 11C, into the BRF 630, where the second portion 621 is obtained by using a time delay unit 620, which creates a time delay of about half the period of the reference signal 601. In an alternative exemplary embodiment of the present invention, the time delay is predetermined. In an alternative exemplary embodiment of the present invention, the time delay is an odd multiple of about one half of the period of the reference signal. The signals 602 and 621 entering the BRF 630 have the same power level, but are opposite in phase. A person skilled in the art will appreciate that the signals 602 and 621 entering the BRF 630 may have about the same power level.

The BRF 630 outputs signals 631, 632 illustrated by waveforms 1831, 1832 respectively, when the bias voltage of the variable capacitors 622, 623 of BRF 630 has a value V1. The BRF 630 outputs signals 631, 632 illustrated by waveforms 1831B, 1832B respectively, when the bias voltage of the variable capacitors 622, 623 of BRF 630 has a value V2. In an alternative exemplary embodiment of the present invention, the phase shift of the output signal relative to the received reference signal is in the range of about −100 to about +100 degrees. The reflection amplifiers 640 and 650 output signals 641 and 651 correspondingly. Signals 641 and 651 are fed into a combiner 661, which outputs signal 661. Signals 641, 651 are represented by waveforms 1841, 1851 respectively, when the bias voltage of the variable capacitors 1622, 1623 of BRF 630 has a value V1. Signals 641, 651 are represented by waveforms 1841B, 1851B respectively, when the bias voltage of the variable capacitors 622, 623 of BRF 630 has a value V2.

From FIGS. 11A, 11B, 11C, 11D it can be noticed that the frequency of the signal 661, represented by waveforms 1861, 1861B, has twice the frequency of signal 601. Furthermore, the phase of waveform 1861, corresponding to bias voltage V1, differs from the phase of waveform 1861B, corresponding to bias voltage V2.

Figure 12:
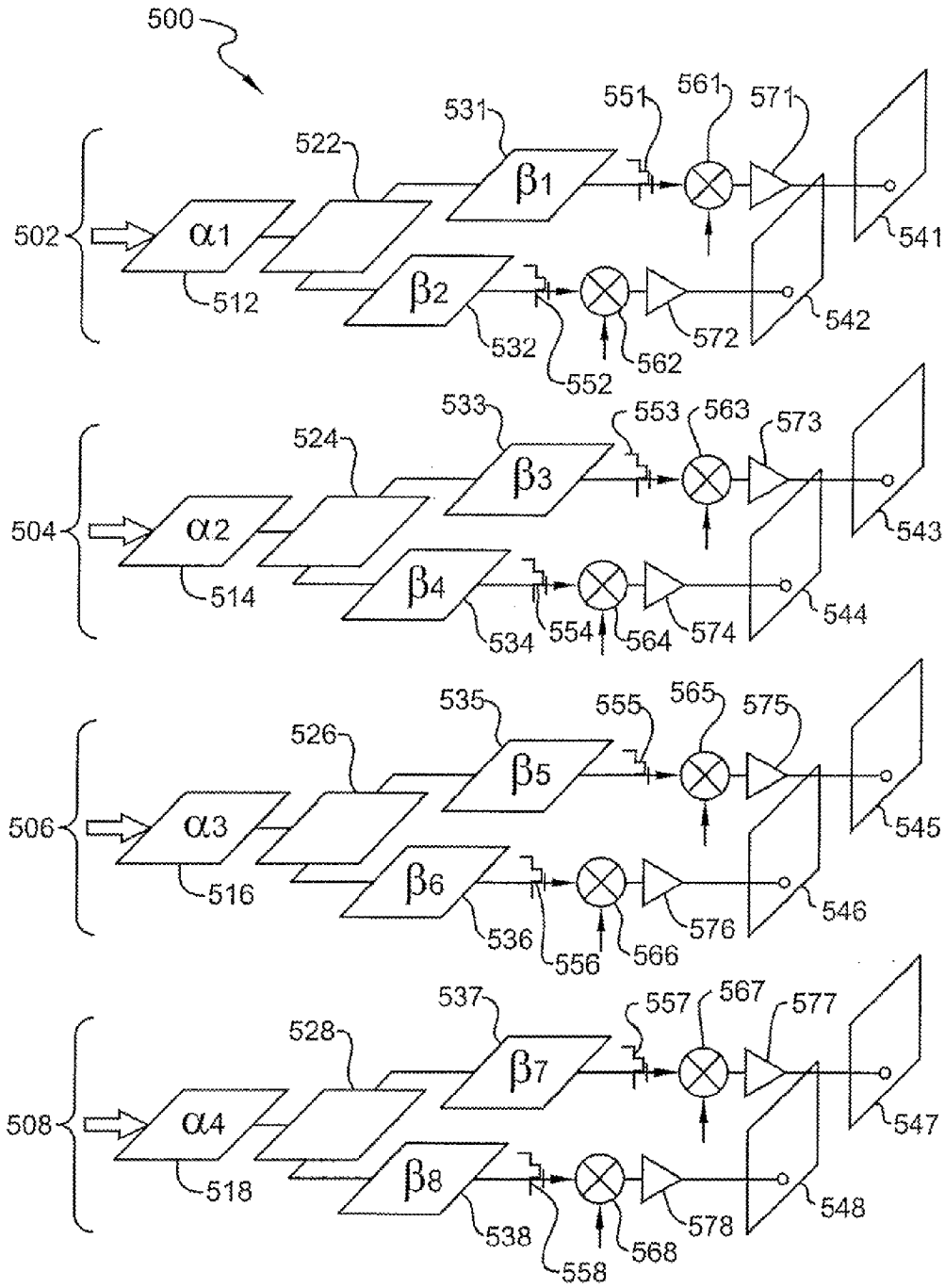
FIG. 12 illustrates a phased array antenna, able to steer the antenna beam in azimuth and elevation, in accordance with an exemplary embodiment of the invention.

FIG. 12 illustrates a PAA, able to steer the antenna beam in azimuth and elevation, in accordance with an exemplary embodiment of the invention. The exemplary PAA of FIG. 12 has four elementary blocks 502, 504, 506, 508. Persons skilled in art will readily appreciate that the construction of a PAA can be made of a plurality of distributed elementary blocks, and that the present example is shown for the convenience of providing a simple and clear explanation of the present invention. In FIG. 12 numerals 541, 542, 543, 544, 545, 546, 547, 548 refer to radiators, numerals 571, 572, 573, 574, 575, 576, 577, 578 refer to amplifiers, numerals 561, 562, 563, 564, 565, 566, 567, 568 refer to mixers, numerals 551, 552, 553, 554, 555, 556, 557, 558 refer to sampling couplers, numerals 512, 514, 516, 518 refer to PSIPPOs used to steer the antenna beam in the elevation direction, and numerals 531, 532, 533, 534, 535, 536, 537, 538 refer to PSIPPOs are used to steer the antenna beam in the azimuth direction. In an exemplary embodiment of the invention PSIPPOs 531, 533, 535, 537 are being phase shifted by angle .beta.1, .beta.3, .beta.5, .beta.7 respectively PSIPPOs 532, 534, 536, 538 are being phase shifted by angle .beta.2, .beta.4, .beta.6, .beta.8 respectively, and PSIPPOs 512, 514, 516, 518, are being phased shifted by angle .alpha.1, .alpha.2, .alpha.3, .alpha.4 respectively.

In a particular example angles .beta.1=.beta.3=.beta.5=.beta.7=100 degrees, angles .beta.2=.beta.4=.beta.6=.beta.8=0 degrees, and angle .alpha.4=−150 degrees, angle .alpha.2=−50 degrees, angle .alpha.3=+50 degrees, angle .alpha.4=+150 degrees. Other angles will be readily appreciated from the above example.

The system described in FIG. 12 is an example of simple PAA, able to steer the beam in elevation and azimuth. Taking as reference the block 502, the signal generated by the distributed network of PSIPPO has the purpose of providing the mixers 561, 562 with the proper RF pump, for up-converting the modulating signal. The modulating signal will enter the mixers as indicated by the arrows shown in the symbols of the mixers. The sampling capacitors 551, 552 have the purpose of providing the down converters of the receiver (not shown) with the proper pump for down-converting the received signal.

FIG. 11 also demonstrates a distributed PAA architecture, in the sense that a PSSIO, such as 512, 514, 516, and 518 affects more than one radiator, while in a non-distributed architecture a phase shifter in a T/R module, affects only one radiator.

Figure 1A:
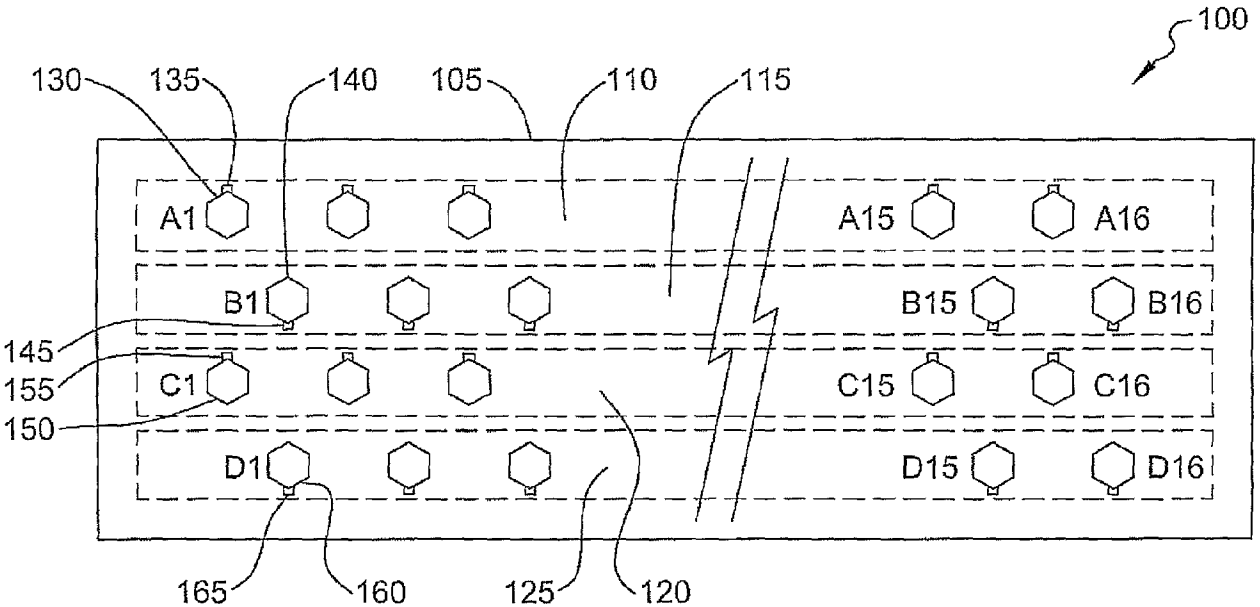
FIG. 1A is a schematic illustration of a phased array antenna unit according to an exemplary embodiment of the invention.

FIG. 1A shows a radiating part of an active phased array antenna (APAA) (referred to as "antenna unit") 100 that includes four or more one-dimensional arrays of radiators (referred to as "radiators") 110, 115, 120, 125, which can be implemented using microstrip technology, located on a rectangular casing 105, consisting on a dielectric substrate with the related base plate. The entire antenna array specifically described in FIG. 1A consists of 64 radiators marked as A1 to A16, B1 to B16, C1 to C16 and D1 to D16. However, different numbers of radiators may be used depending on the required power output and precision. Each radiator is shaped as a hexagonal patch, for example radiator A1, 130. Each radiator has a feeder (an I/O port that conveys the electromagnetic wave to and from the radiator) 135, 145, 155, 165 either at the upper vertex of the radiator (e.g. A1 to A16, C1 to C16), or at the lower vertex of the radiator (e.g. B1 to B16, D1 to D16). The hexagonal shape of the radiator has been shown by simulation to provide better results than a square radiator or a circular radiator, in terms of transmission gain and/or receiving gain and also by providing relatively good isolation between adjacent radiators. However, different geometrical shapes may be selected.

It should be noted that while the one dimensional array of radiators that is shown in FIG. 1A is linear (radiators are located along a straight line) and symmetric (equal distances between radiators), in another exemplary embodiments according to the invention the one dimensional array of radiators may be non linear or not symmetric.

In an exemplary embodiment of the present invention, the positioning of the radiator's feeder forms a symmetric structure, in the first and third one-dimensional array of radiators the radiator's feeders are located at the upper vertex of the hexagonal patch, while at the second and fourth one-dimensional array of radiators the radiator's feeders are located at the lower vertex of the patch. It should be noted that this symmetric positioning of the radiator's feeder optionally contributes to achieving a symmetrical radiation pattern.

In an exemplary embodiment of the invention the even one dimensional arrays of radiators are shifted with reference to the odd one dimensional arrays of radiators by about half of the distance between two adjacent radiators, thus radiator B1 140 is not shown under radiator A1 130 but between radiator A1 and A2. This deployment of radiators enables to optimize the density of radiators at a given area which results with improved beam formation.

Figure 1B:
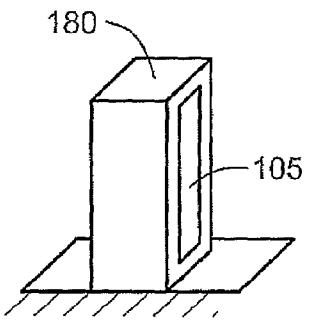
FIG. 1B is a schematic view of a phased array antenna system including four phased array antenna units, located on a vertical pole according to an exemplary embodiment of the invention.

While FIG. 1A shows the antenna casing 105 in horizontal orientation, for practical use in an APAA system—the antenna will be positioned vertically, i.e. radiators A1, B1, C1, and D1 will be located at the upper end of the antenna and radiators A16, B16, C16 and D16 will be positioned at the lower end of the antenna. As shown in FIG. 1B.

The antenna dimensions depend on the wave's frequency and the dielectric constant of the substrate. However, for use in some applications, such as for example, WI-MAX application, the radiators dimensions will typically not exceed a few centimeters.

In an exemplary embodiment of the invention, to achieve wider azimuth angle coverage with still high power density for communicating with devices in the area of coverage of antenna 100 three different radiation patterns (referred to as "radiation modes") are generated with the same physical array of radiators.

Optionally, production of the multiple radiation modes by antenna 100 is defined by the relative phase shift to a signal among the four one-dimensional arrays of radiators 110, 115, 120, 125.

In an exemplary embodiment of the present invention, a first radiation mode is defined by providing the following phase shift pattern to the four one-dimensional arrays of radiators 110, 115, 120, 125. Optionally, the first one-dimensional array of radiators 110 gets a 0 degree phase shift—this array serves as a reference array. The second one-dimensional array of radiators 115 gets the same phase shift of 0 degrees as the first array. The third one-dimensional array of radiators 120 gets a phase shift of 180 degrees with reference to the first one-dimensional array of radiators 110 (i.e. for each $1<=i<=16$ radiator Ci is phase shifted 180 degrees with reference to the corresponding radiator Ai in first one-dimensional array of radiators 110. The same applies for the fourth one-dimensional array which is also shifted 180 degrees with reference to the first one-dimensional array of radiators.

It should be noted that it is possible to both transmit and receive via the same radiators and it is typically the more efficient architecture. However in an exemplary embodiment of the invention, the transmission and receiving is split between transmitting radiators and receiving radiators. Deployment of different radiators for transmission and receiving may be carried out in various topologies, such as separating the functions to two different phased array units or alternatively define sub groups of the radiators in a phased array unit for transmission while the complementary sub group is used for receiving.

Figure 2A:
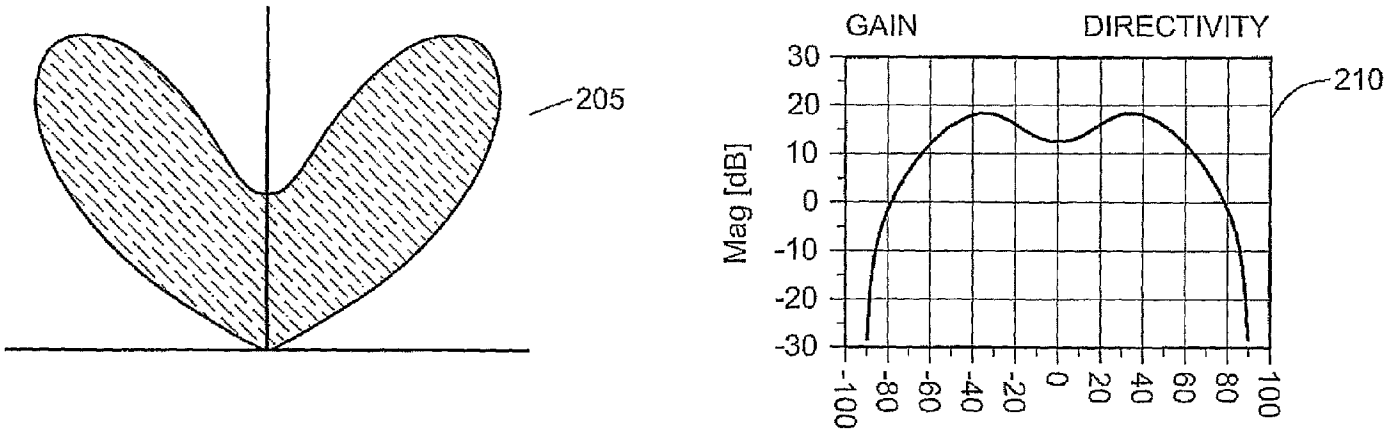
FIG. 2A is a graphic description of the radiation pattern of a phased array antenna unit in a first mode of operation, (polar and Cartesian), according to an exemplary embodiment of the invention.

FIG. 2A shows a schematic view of the polar presentation of the beam 205, and Cartesian representation 210 of the radiation pattern at the first radiation mode indicating on the azimuth coverage of the antenna, according to an exemplary embodiment of the invention. The azimuth angle that is covered by beam 205 (for transmission and reception) is a substantially planar shaped beam, which has a vertical dimension of about 5 degrees of aperture. This narrow aperture angle depends on the number of radiators in a single one dimensional array.

FIG. 2A further shows a Cartesian graph 210 which describes the antenna gain (dB) versus azimuth.

As will be further explained below the system is able to conduct a vertical steering of the radiation pattern, giving the phase 0 or 180 degrees to the radiators Ak, Bk, Ck Dk; and adding phases equally linearly distributed to the radiators of each one dimensional array. This way the proper elevation angle will be covered. Azimuth coverage by three antenna radiation modes, together with elevation by electronic steering of the phased array antenna, will enable the system to cover a wide solid angle, with high power density of the transmitted signal.

FIG. 2A shows that the first radiation mode creates two main lobes that cover an angle of about 100 degrees. However, this first radiation mode provides best coverage at two maximum points (forming the two lobes) and weaker coverage at the mid section—between the two main lobes. Optionally, as described below other radiation modes will be used to enhance coverage in the areas where the beam 205 of the first radiation mode is not at its best.

Optionally, the first radiation mode is achieved by providing the following phase shifts to the four one-dimensional arrays of radiators 110, 115, 120, 125. Optionally, the first one-dimensional array of radiators 110, which serves as a reference gets a 0 degrees phase shift, the second one-dimensional array of radiators 115 gets the same phase shift (i.e. 0 degrees) with reference to the first one-dimensional array of radiators 110. The third one-dimensional array of radiators 120 gets a 180 degrees shift with reference to the first one-dimensional array of radiators 110. The fourth one-dimensional array of radiators 125 also gets a 180 degrees shift with reference to the first one-dimensional array of radiators 110 (i.e. same phase shift as the third one-dimensional array of radiators).

Figure 2B:
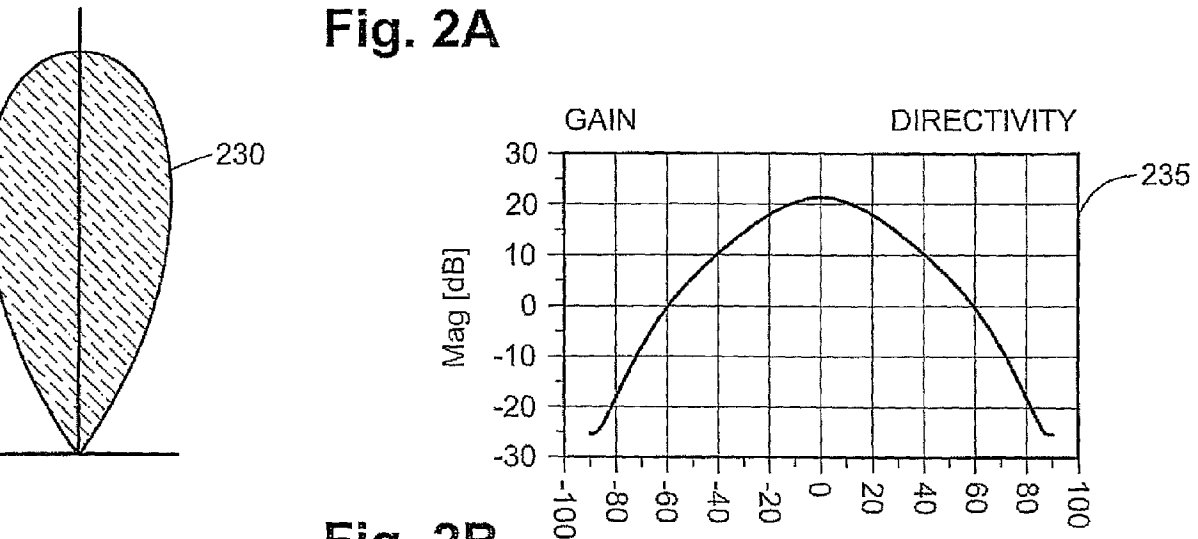
FIG. 2B is a graphic description of the radiation pattern of a phased array antenna unit in a second mode of operation, (polar and Cartesian), according to an exemplary embodiment of the invention.

FIG. 2B shows the polar 230, and Cartesian 235 representation of the radiation pattern of the second radiation mode, so that the azimuth coverage of the second radiation mode can be appreciated, according to an exemplary embodiment of the invention. Optionally, the second radiation mode is achieved by providing the following phase shifts to the four one-dimensional arrays of radiators 110, 115, 120, 125. Optionally, the first one-dimensional array of radiators 110, which serves as a reference gets a 0 degrees phase shift, the second one-dimensional array of radiators 115 gets a 180 degrees phase shift with reference to the first one-dimensional array of radiators. The third one-dimensional array of radiators 120 gets a 0 degrees shift, i.e. the same phase that is provided to the first one-dimensional array of radiators 110. The fourth one-dimensional array of radiators 125 gets a phase shift of 180 degrees with reference to the first one-dimensional array 110.

FIG. 2B further shows a Cartesian graph 235 which describes the antenna gain (dB) versus azimuth.

FIG. 2B shows that the second radiation mode provides transmission and reception coverage in one main lobe. As mentioned for the first mode, the vertical beam angle of the second radiation mode has the same narrow aperture of about 5 degrees.

Figure 2C:
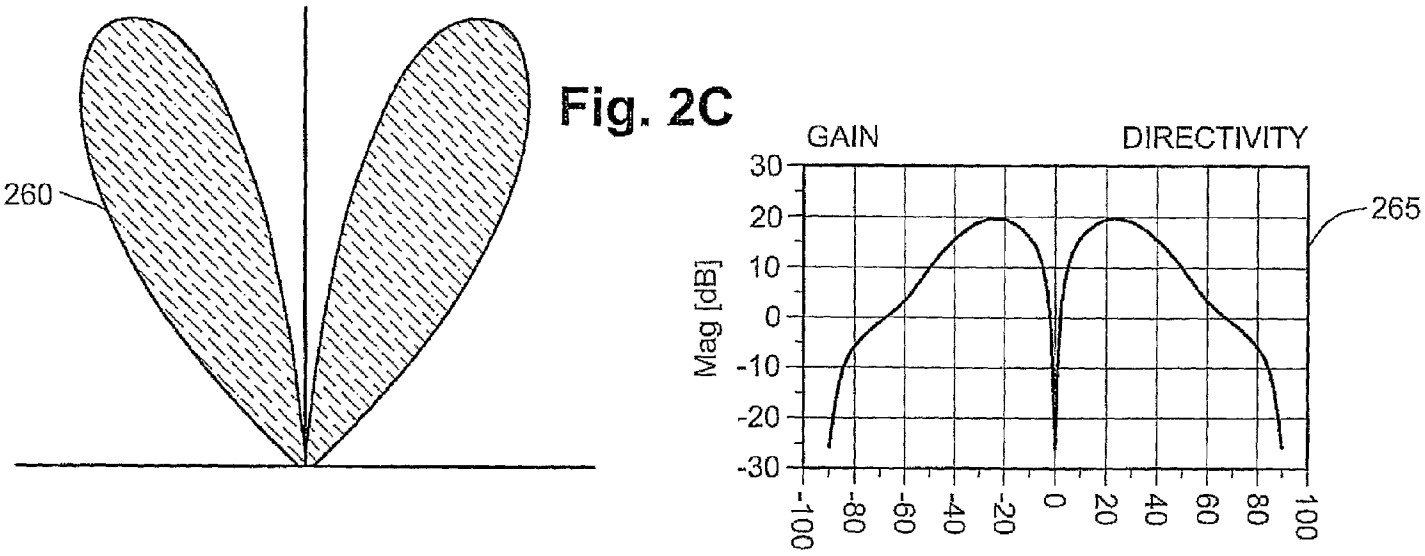
FIG. 2C is a graphic description of the radiation pattern of a phased array antenna unit at a third mode of operation, (polar and Cartesian): according to an exemplary embodiment of the invention.

FIG. 2C shows the polar 260, and Cartesian representation 265 of the radiation pattern of the third radiation mode, indicating on the azimuth coverage of the third radiation mode, according to an exemplary embodiment of the invention. The third radiation mode is achieved by providing the following phase shifts to the four one-dimensional arrays of radiators: The first one-dimensional array of radiators 110, which serves as a reference gets a 0 degrees phase shift, the second one-dimensional array of radiators 115 gets a 180 degrees phase shift with reference to the first one-dimensional array of radiators. The third one-dimensional array 120 gets a 180 degrees shift. The fourth one-dimensional array of radiators 125 gets a phase shift of 0 degrees with reference to the first one-dimensional array of radiators 110, i.e. the same phase that is provided to the first one-dimensional array of radiators 110.

FIG. 2C further shows a Cartesian graph 265 which describes the antenna gain (dB) versus azimuth FIG. 2C shows that the third radiation mode provides transmission and reception coverage in two main lobes which provide optimal coverage of the gap between the area covered by the first and second radiation modes. As mentioned for the first radiation mode, the vertical beam angle of the third radiation mode has the same narrow aperture of about 5 degrees.

Figure 2D:
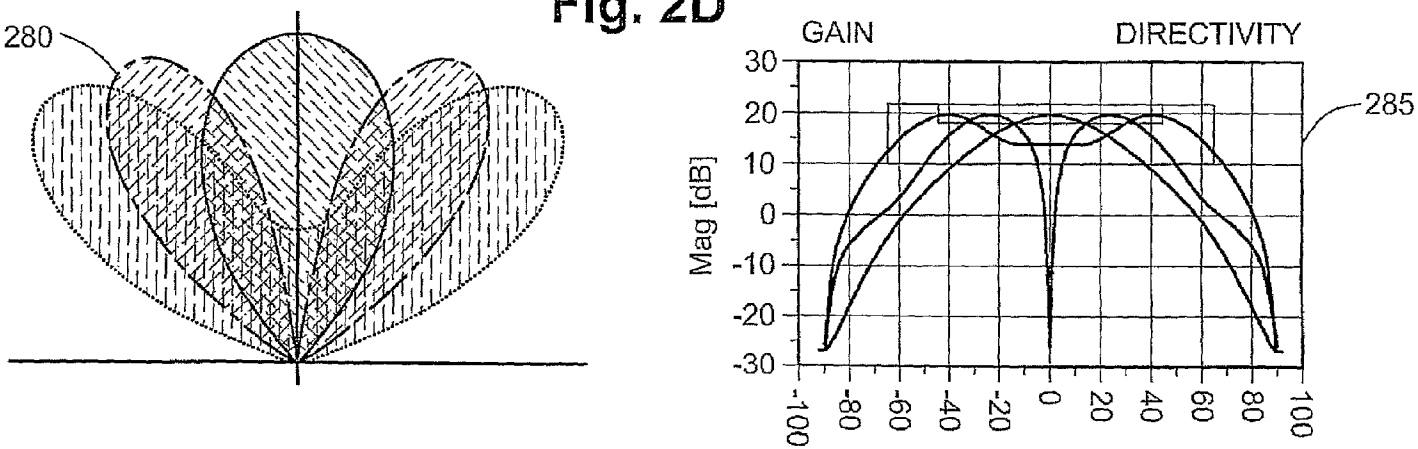
FIG. 2D is a graphic description of the radiation pattern of a phased array antenna unit summarizing three modes of operation, (polar and Cartesian), where each mode is operated at different times, accordingly with the service needs according to an exemplary embodiment of the invention.
Figure 2E:
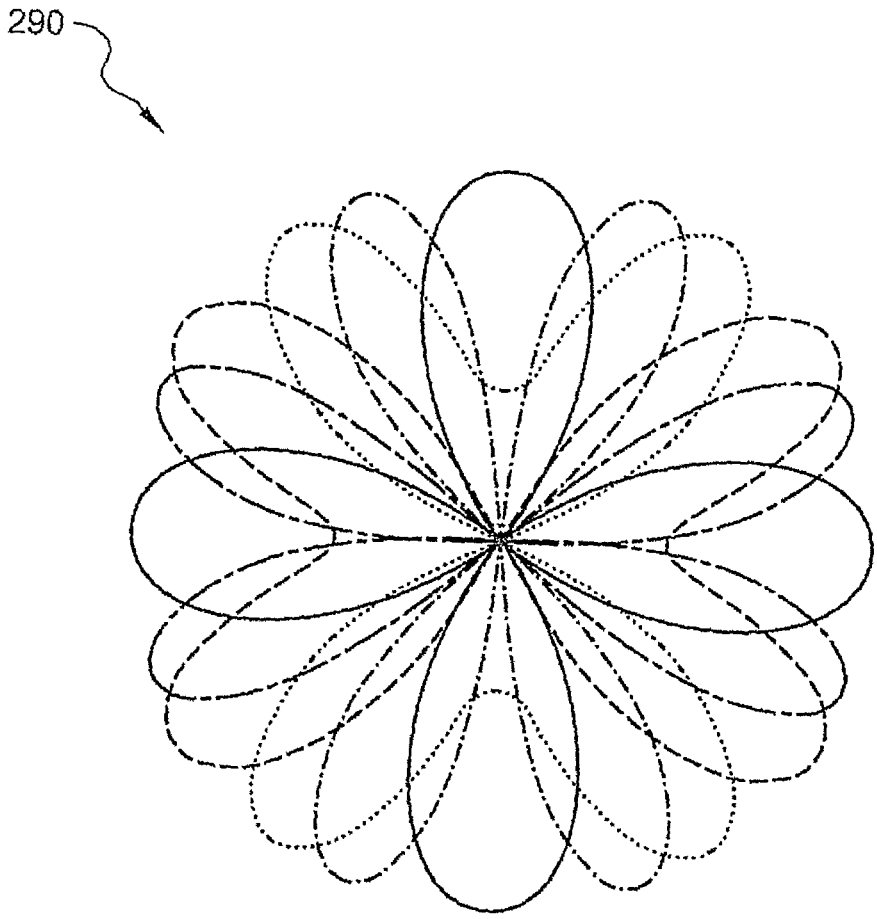
FIG. 2E is a polar graphic description of the radiation pattern of phased array antenna units summarizing three modes of operation of four phased array antenna units that are located on four sides of a single pole, according to an exemplary embodiment of the invention.

FIG. 2D shows the coverage that is provided by the summation of all the three modes. It shows that the summation of the three modes, polar view 280, and Cartesian view 285 provides a good coverage of a section that is greater than 90 degrees wide.

In some embodiments of the invention, the APAA system will switch between less than three modes or more than three modes.

In some embodiments of the invention, the APAA system may provide a phase shift that is greater or smaller than 180 degrees to the one-dimensional arrays of radiators In some embodiments of the invention, the APAA system may include more or less than four one-dimensional arrays of radiators.

In some embodiments of the invention, the APAA system may include various combinations of radiators other than one-dimensional arrays of radiators, where any sub-group (referred to as group) of the radiators will be associated with a programmable phase shift with reference to any reference sub-group. For example the antenna unit may include eight one-dimensional arrays of radiators, wherein the first and second one-dimensional arrays of radiator will consist a first group of radiators, the third and fourth one-dimensional arrays of radiator will consist a second group of radiators, the fifth and sixth one-dimensional arrays of radiator will consist a third group of radiators, the seventh and eighth one-dimensional arrays of radiator will consist a fourth group of radiators.

In a more general case the antenna unit may consist of N (integer practically greater than eight) radiators located at any possible geometry, where the system is selectively switching between radiation modes, wherein a radiation mode is defined by the number of groups and the phase shift that is associated with each group.

While operating the APAA system according to an exemplary embodiment of the present invention, the system switches among the three radiation modes. The switching may be a periodic switching pattern or any desired pattern. In an exemplary embodiment of the invention, the system is able to alter the switching pattern to accommodate dynamic situations, for example when receiving or transmitting sources join or leave the area that is covered by the system, or when different needs and priorities are required. Optionally, alteration of the switching pattern provides priority in coverage of one area over another, for example to increase the bandwidth to a specific client device.

Figure 3A:
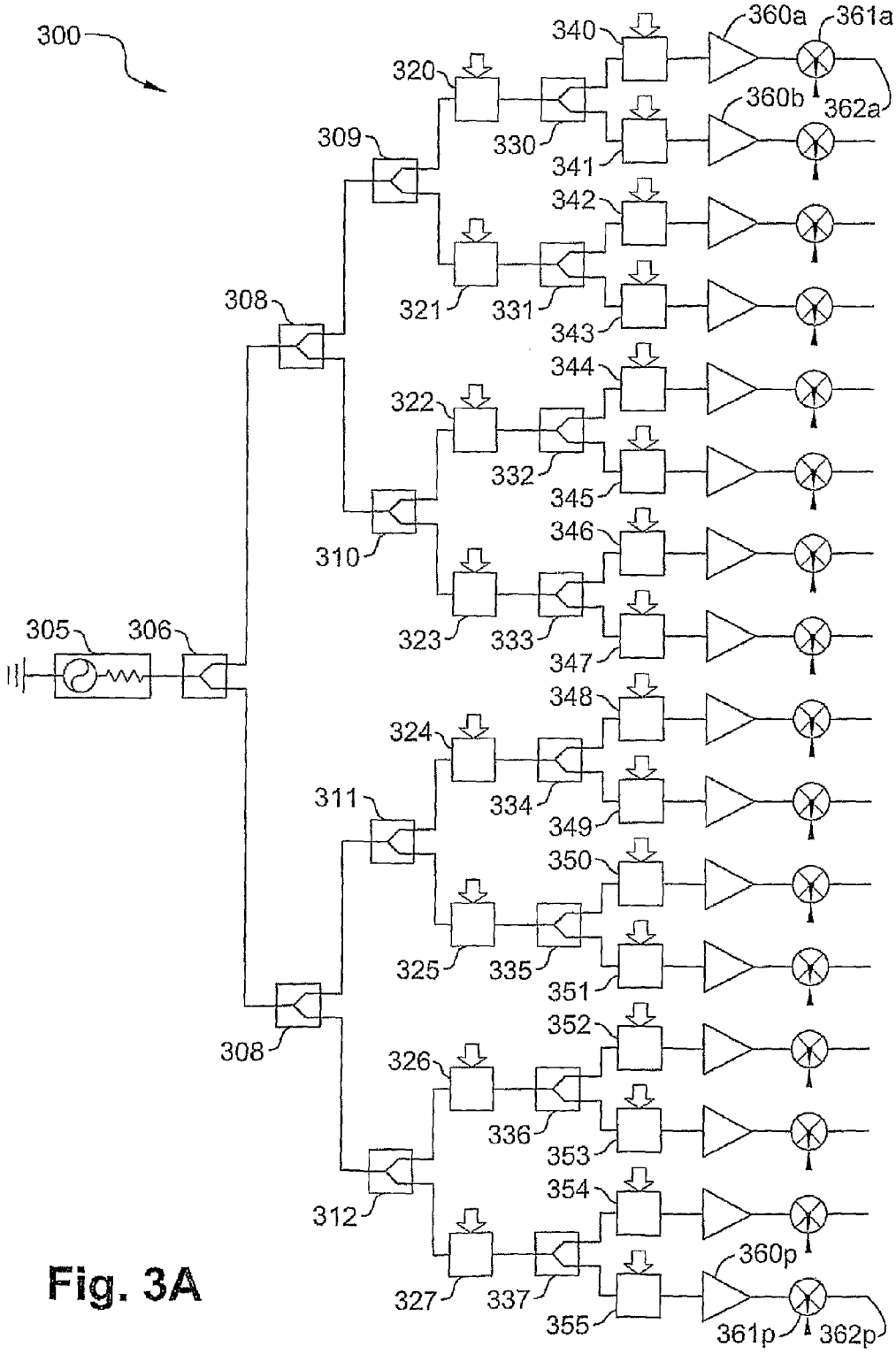
FIG. 3A is a schematic illustration of the base of a circuit for implementing a phased array antenna circuit that supports a combination of three modes of operation according to an exemplary embodiment of the invention.
Figure 3B:
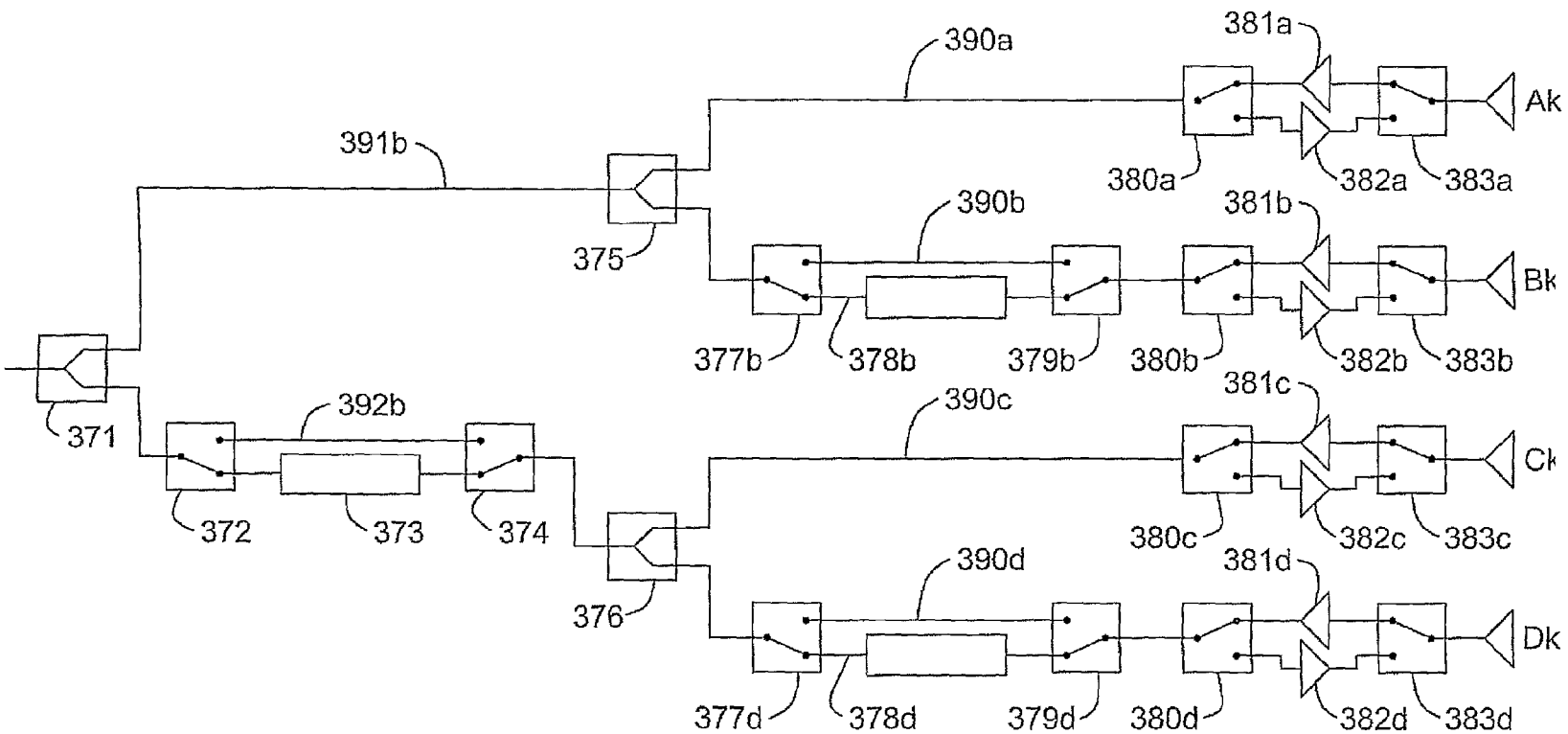
FIG. 3B is a schematic illustration of the front end of the transceiver, connected to the high frequency ports of the mixers of FIG. 3A to implement a phased array antenna circuit that supports a combination of three modes of operation according to an exemplary embodiment of the invention.

The use of radiation modes where the phase shift between the one-dimensional arrays of radiators is either zero degrees or 180° enables to simplify the electronic circuits that support the transmission and receiving in the APAA system as shown in FIG. 3A and FIG. 3B.

FIG. 3A is an exemplary illustration of the base of a circuit for providing a radiation signal to an array of radiators, according to an exemplary embodiment of the invention.

As described in details in PCT/IL2006/001144, the circuit uses an oscillator unit 305 whose output splits to eight branches through the splitting elements 306-312, called "manifold". The signals then arrive to a first level of PSIPPO (phase shift push-push oscillator) 320-327. Persons skilled in the art will readily appreciate that the phase shift that is determined at this level of PSIPPO serves to steer the beam in elevation. It can be anticipated that, applying a zero degree phase shift at the first and second level of PSIPPO, the radiation pattern, (beam), will be a flat kind of "fan" as described in FIGS. 2A 2B and 2C and referenced by the numerals 205, 230, and 260 respectively, which has its symmetry axis perpendicular to the antenna surface.

The signals exiting the first level of PSIPPO are split by another level of splitting elements 330-337 and proceeds to a second level of PSIPPO 340-355 which contributes in steering the beam in elevation. FIG. 3A shows the components of the system, starting from the Master Oscillator 305 at very low frequency, then the power splitters of the manifolds 306-312, the PSIPPO of the two levels 320-327 and 340-355, till the mixers 361*a*-361*p* that are behaving as Up-Converters or Down-Converters, depending on the position of the switches 380*a*-380*d* and 383*a*-383*d* located near the radiators and depicted in FIG. 3B.

The same system behavior can be secured, in principle, by a circuit structure without the switched lines shown in FIG. 3B. However this solution involves much higher number of components, and provides lower commercial benefit.

In the general case, transmitting or receiving by a 16×4 radiators antenna would require the use of four circuits as shown in FIG. 3A. However, using the schematic of FIG. 3B the system becomes less expensive and more effective. In fact FIG. 3B, with the two levels of switched lines of the upper and lower paths, is able to deliver to the radiators Ak, Bk, Ck, Dk signals with phases of 0 degrees or phased by 180 degrees. That means: only one subsystem of FIG. 3A will be sufficient to feed all the signals required by the three antenna modes.

With reference to FIG. 3A, the signals coming from the second level of PSIPPO 340-355 are the pump signals able to Up-Convert, (or Down-Convert), the base band signals entering the mixers through the IF port, (or the RF signal coming from the radiators, entering the mixers through the RF port). The fact that the same signals, with the same phases, are used for transmitting and receiving operations, secures the same direction of the beam in transmission and reception.

The high frequency port of the sixteen mixers will be each one connected to a block of FIG. 3B. Every high frequency port of the mixers will deliver, (or receive), signal to, (from), the set of four radiators Ak, Bk, Ck, Dk, with 1<=k<=16.

FIG. 3B shows a low cost, simple circuit that enables to provide a phase shifted signal to four one dimensional arrays of four radiators, each one belonging to one of the 4 different linear arrays, each containing 16 elements, at the same position in the array. The circuit that is shown in FIG. 3B is duplicated sixteen times, corresponding to the 16 positions of the patches in a single array, and is connected to each of the mixers 361*a*-361*p*. FIG. 3B includes three identical switch paths the first includes a delay element 373 and two switches 372 and 374. The second switch path includes a delay element 378*b* and two switches 377*b* and 379*b* and the third switch path includes a delay element 378*d* and two switches 377*d* and 379*d*. The circuit further includes four direction sub circuits each including the switches 380,383 and the amplifiers 381,382 wherein the index a-d indicates the sub circuit respectively.

Returning now to FIG. 2A—in order to operate in the first radiation mode, a phase shift of 180 degrees should be provided to both the third and fourth one-dimensional arrays of radiators, while a phase shift of 0 degrees should be provided to both the first and second one-dimensional arrays of radiators. This is implemented by selecting the following paths in FIG. 3B:

Radiator Ak will radiate the signal that follow the path through 390*a*, with reference phase 0 degrees.

Radiator Bk will radiate the signal that follows the path through 1001/1000/401/500, with phase 0 degrees.

Radiator Ck will radiate the signal that follows the path through 390*c*, with phase 180 degrees, as far as the signal is routed through delay element 373 that shifts the signal by 180 degrees.

Radiator Dk will radiate the signal that follows the path through 390*d*, with phase 180 degrees, as far as path the signal is routed through delay element 373 that shifts the signal by 180 degrees.

In order to drive the signal to all 16×4 radiators similar, (or identical: depending on the beam steering), operation is performed by the signals exiting all the "k" mixers, where 1<=k<=16.

It should be noted that the delay elements 373, 378*b* and 378*d* are simple and low cost transmission lines, and paths 391*a*, 390*a*, 390*b*, 390 and 390*d* are also simple transmission lines. The electrical difference between the first and the second group of lines is 180 degrees. The usage of electronic switches and transmission lines, instead of using multiple subsystem of FIG. 3A, reduces both cost and size of the entire system.

Figure 4:
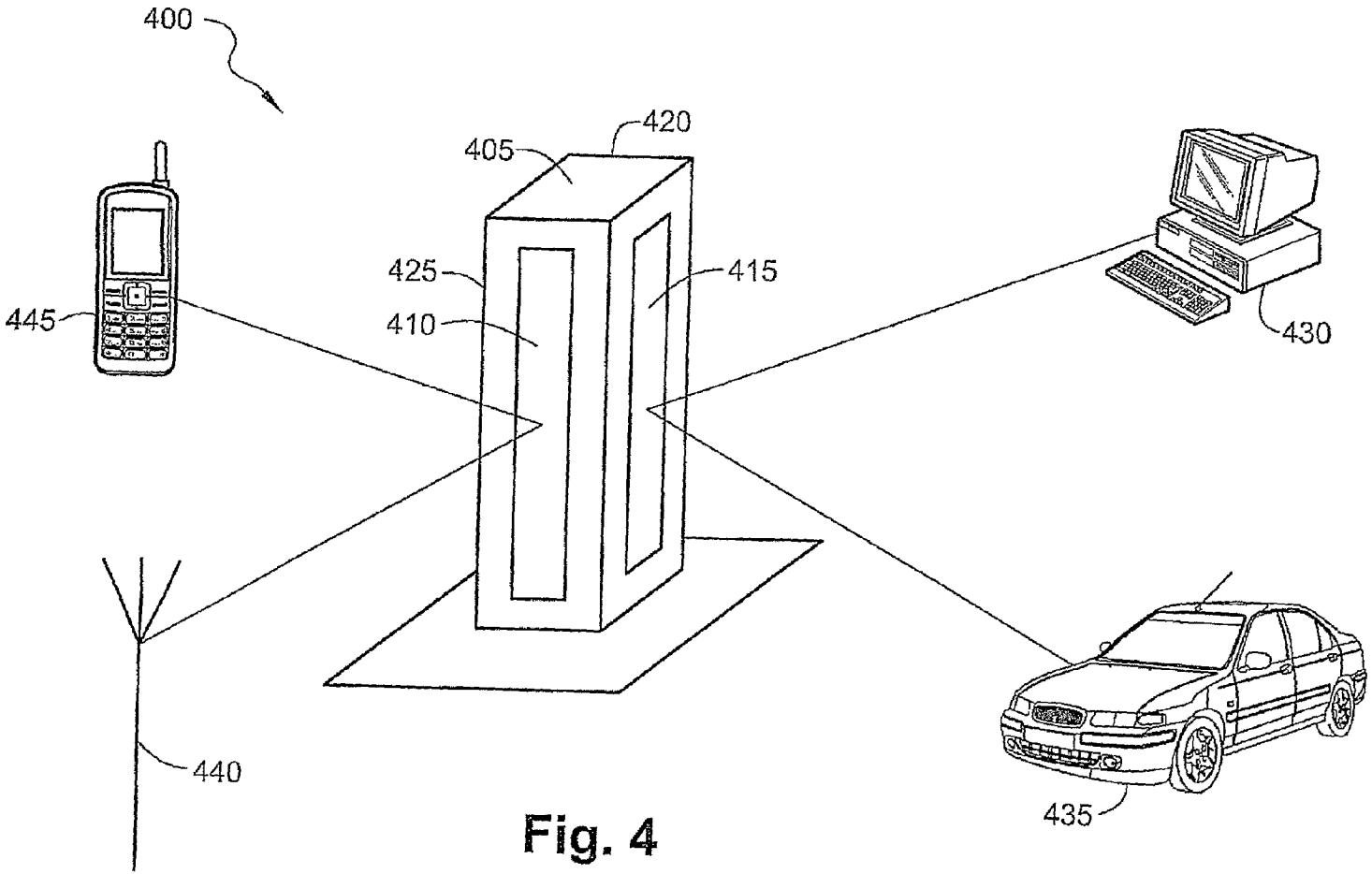
FIG. 4 is an illustration of a 360 degree phased array antenna system communicating with three transmitting/receiving end points according to an exemplary embodiment of the present invention.

FIG. 4 shows an APAA system 400 according to an exemplary embodiment of the present invention. The system consists of four phased array antenna units 410, 415, 420 and 425 each located on a different side of a pole 405.

In an exemplary embodiment of the invention, each of the four phased array antenna units covers more than 90 degrees in azimuth in a way that all the four phased array antenna units cover 360 degrees. Each phased array antenna unit switches among the three radiating modes as described with reference to FIG. 2A-2C. Simultaneously each of the four phased array antenna units also steers the elevation of the beam. Steering the beam vertically is controlled by the two arrays of PSIPPO 320-327 and 350-355 (FIG. 3A).

Optionally all four phased array units are controlled by a single phased array circuit. In another exemplary embodiment of the invention each of, or part of the four phased array units is controlled and driven by a separate phased array circuit.

While transmitting and receiving data, the system may detect a PC device 430 that transmits data to the phased array antenna unit 415, and a car control device 435 that also transmits data to the same phased array antenna unit 415. FIG. 4 further shows an antenna of a repeater device 440 and a cell phone device 445 which are transmitting data that is received by the phased array antenna unit 410. Since the system is switching between the three radiation modes, each device transmission is intercepted at a different intensity at each of the three radiation modes. In an exemplary embodiment of the present invention, the system identifies for each device the best receiving mode among the three modes, when the received signal is maximal and allocates priority in transmitting and receiving to the device in the best receiving mode. Thus, assuming that the best receiving mode for the PC device 430 is the first radiation mode and the best receiving mode for the car control device is the third radiation mode, the system may reduce the time allocated for transmission and receiving in the second radiation mode and increase the time allocated to the first and third radiation modes. In an exemplary embodiment of the invention the system allocates transmission and reception time slots also according to bandwidth requirements that are imposed by the transmitting devices. In an exemplary embodiment of the invention the system allocates time slots for varying elevations considering the elevation where transmitting devices were best received.

In an exemplary embodiment of the invention there is a separate control circuit for each of the four phased array antenna units 410, 415, 420 and 425 thus enabling to optimize bandwidth needs separately for each of the four phased array antennas.

While the foregoing description referred to an APAA system, it will be appreciated by persons skilled in the art that the present invention is not limited to active communication but is applicable for any suitable communication protocol or methods, to include for example, WIMAX, WI-FI, WPAN, as well as for HDTV (high definition T.V.) or cellular communication standards and protocols.

It should be appreciated that the above described methods and systems may be varied in many ways, including omitting or adding steps, changing the order of steps and the type of devices used. It should be appreciated that different features may be combined in different ways. In particular, not all the features shown above in a particular embodiment are necessary in every embodiment of the invention. Further combinations of the above features are also considered to be within the scope of some embodiments of the invention. For example, the system, as described above, can work with 4 linear arrays of antennas, each one containing whatever number of radiators.

It will be appreciated by persons skilled in the art that the present invention is not limited to what has been particularly shown and described hereinabove. Rather the scope of the present invention is defined only by the claims, which follow.

The invention claimed is:

1. A wireless communication system comprising:

at least one active phased array antenna unit for transmission and reception of data communication;

a phased array circuit for driving and controlling said at least one phased array antenna unit, wherein said at least one phased array antenna unit comprises at least four one dimensional arrays of radiators and wherein said phased array antenna circuit comprises a plurality of phased shifted injection locked push-push oscillators (PSIPPO).

2. The system according to claim 1, wherein said at least four one dimensional arrays of radiators are linear.

3. The system according to claim 1, wherein the at least one phased array antenna unit is positioned in a vertical orientation.

4. The system according to claim 1, wherein said at least four one dimensional arrays of radiators are linear and symmetric.

5. The system according to claim 4, wherein adjacent one dimensional arrays of radiators are shifted with respect to each other by about half of the distance between two adjacent radiators.

6. The system according to claim 1, wherein said at least one phased array antenna unit comprises at least four groups of radiators, wherein one of said at least four groups of radiators is defined as a reference group and at least two of said at least four groups of radiators are controlled by said phased array circuit to transmit and receive with a programmable phase shift relative to said reference group.

7. The system according to claim 6, wherein each group of radiators comprises at least one dimensional array of radiators.

8. The system according to claim 6, wherein the programmable phase shift can vary between +180 and −180 degrees.

9. The system according to claim 6, comprising a circuit for selectively switching among at least three radiation modes, where a radiation mode is defined according to the number of groups of radiators that transmit and receive each in a different phase shift and according to said programmable phase shift that is associated with each group of radiators.

10. The system according to claim 9, comprising at least four phased array antenna units mounted on four faces of a rectangle basis enabling range of 360 degrees of communication coverage.

11. The system according to claim 9, wherein the circuit that is selectively switching between the at least three radiation modes is responsive to signal level that is received in the at least three radiation modes.

12. The system according to claim 1, wherein said phased array circuit controls said phased array antenna unit to radiate in a narrow vertical beam aperture; having a vertical dimension of about 5 degrees of aperture.

13. The system according to claim 12, wherein said narrow vertical beam aperture is steered vertically according to a programmable pattern.

14. The system according to claim 13, wherein said phased array circuit includes two levels of PSIPPO; and wherein said narrow vertical beam aperture is steered vertically according to a programmable pattern by providing control signals to said two levels of PSIPPO.

15. The system according to claim 1, wherein the at least one phased array antenna unit for transmission and reception of electronic radiation and the phased array circuit are adapted for transmission and reception of WIMAX or WIFI or WPAN or HDTV or cellular communication compliant data signals.

16. The system according to claim 1, wherein the system comprises four phased array antennas, positioned in a substantially rectangle structure to cover a 360 degrees of the area surrounding the antennas.

17. Phased array communication method comprising the steps of:

a. providing at least one phased array antenna unit for transmission and reception of a radiation, wherein said at least one phased array antenna unit comprises at least four one dimensional arrays of radiators, and wherein said phased array antenna circuit comprises a plurality of phased shifted injection locked push-push oscillators (PSIPPO);

b. providing a phased array circuit for driving and controlling said at least one phased array antenna unit, c. transmitting or receiving electromagnetic radiation, using said at least one phased array antenna unit, wherein said transmitting or receiving electromagnetic radiation is performed by selectively switching among radiation modes, wherein a radiation mode is defined by a phase shift that is associated with each radiator at any point in time.

18. A circuit for driving a phased array antenna wireless communication system, comprising:

a. an oscillator circuit for providing a reference signal, b. at least two levels of phase shifted injection locked push-push oscillators for steering a beam that is created by a phased array antenna frame;

c. up converters for up converting a signal that is transmitted by the phased array antenna and down converters for down converting a signal that is received by the phased array antenna frame; and d. transmission lines for selectively providing a phase shift to a reference signal that is provided to said up or down converters.

19. The circuit for driving a phased array antenna wireless communication system according to claim 18, wherein at least one of the at least two levels of phase shifted injection locked push-push oscillators is used for steering a beam that is created by the phased array antenna frame horizontally, and at least one of the at least two levels of phase shifted locked injected push-push oscillators is used for steering a beam that is created by the phased array antenna frame vertically.

* * * * *